US006130375A

United States Patent [19]

Kellogg et al.

[11] Patent Number: 6,130,375

[45] Date of Patent: Oct. 10, 2000

[54] STRINGED INSTRUMENT STAND

[76] Inventors: Greg Kellogg, 2072 Covington Ave.; James R. Miller, 348 Longbranza Rd., both of Simi Valley, Calif. 93065

[21] Appl. No.: 09/371,384

[22] Filed: Aug. 10, 1999

[51] Int. Cl.[7] ..... G10G 5/00

[52] U.S. Cl. ..... 84/327; 84/421; 84/453

[58] Field of Search ..... 84/327, 453, 280, 84/281, 421

[56] References Cited

U.S. PATENT DOCUMENTS 5,197,701 3/1993 Olson ..... 248/166

*Primary Examiner*—David Martin
*Assistant Examiner*—Shih-yung Hsieh

[57] ABSTRACT

String Instrument Stand with an L shaped bracket having a centrally located clevis joint, a hinged flat stand member and a retaining clip. The L shaped member being fixedly retained by the screw and strap button normally found at the base of stringed instruments. The hinged flat stand member being held in place by a hinge pin and being retained in an open position by the retaining clip. A preferred embodiment includes the flat stand member nesting close to the back of stringed instrument so that instrument can be played while instrument stand is affixed.

4 Claims, 3 Drawing Sheets

STRINGED INSTRUMENT STAND

BACKGROUND OF THE INVENTION

This invention relates generally to the field of instrument stands, and more particularly to a stringed instrument stand.

When playing a stringed instrument such as a guitar, banjo, mandolin or the like, it is often necessary for the performer to put the instrument down for a period of time. Such as when changing instruments or when taking a break from playing. For this purpose various types of instrument stands have been designed, manufactured and sold to musicians for many years. The stands generally provide a pair of arms that support the bottom of the instrument and a cradle portion to support the neck of the instrument. The stand is designed to tilt the instrument back slightly so that it is inclined to remain supported by the stand. Some of the stands are collapsible for easier transport. Some stands have a height adjustment for the cradle portion so that the stand can accommodate a variety of instrument styles. There are a number of serious deficiencies in the design of current instrument stands. Many stands are unstable, resulting in the possibility of an expensive instrument being knocked over and damaged. Many are bulky and made of weighty metal. The current stands take up considerable room both in their stored position and in their use position. They also must be carried separately from the instrument and the instrument case.

SUMMARY OF THE INVENTION

The primary object of the invention is to provide a stand for a stringed instrument that is connected to the instrument.

Another object of the invention is to provide a stand that is extremely stable.

Another object of the invention is to provide a stand that collapses flush to the body of the instrument allowing the instrument and stand to be stored in a conventional instrument case.

A further object of the invention is that it provides a stand that, when collapsed, does not present an impediment to playing the instrument.

Yet another object of the invention is to provide a stand that when collapsed acts as a buffer between the player and the instrument thereby preventing scratches to the instrument from the users belt buckle or the like.

Still yet another object of the invention is to provide a stand that is light weight.

Another object of the invention is to provide a stand that is connected by the existing strap button of the instrument thereby eliminating the need for additional screw holes in the instrument.

Another object of the invention is provides a stand that is economical to manufacture.

Other objects and advantages of the present invention will become apparent from the following descriptions, taken in connection with the accompanying drawings, wherein, by way of illustration and example, an embodiment of the present invention is disclosed.

String Instrument Stand comprising: an L shaped bracket having a centrally located clevis joint, a hinged flat stand member and a retaining clip, said L shaped member being fixedly retained by the screw and strap button normally found at the base of stringed instruments, said hinged flat stand member being held in place by a hinge pin and being retained in an open position by said retaining clip, The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
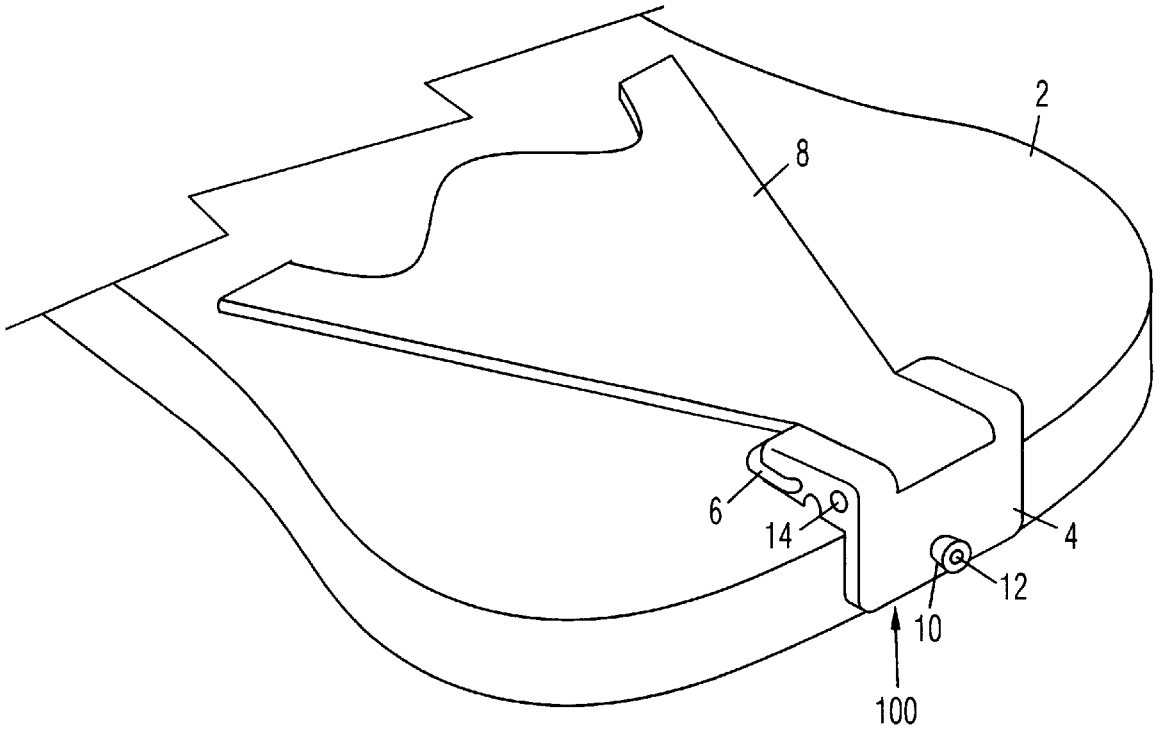
FIG. 1 is perspective view of the stand of the present invention in its closed position while mounted on a stringed instrument.

Referring now to FIG. 1 we see the bottom portion of an electric guitar body 2. L shaped bracket 4 is attached to the bottom of the guitar body 2 by screw 12 and strap button 10. This strap button 10 and screw 12 are found on virtually all guitars, banjo's, mandolin's and the like. It is the strongest point on the instrument since it is designed to support the stresses of a person putting pressure on on the instrument as well as the weight of the instrument itself. Therefore it is an ideal location to attach the instrument stand or the present invention. Additionally, since this attachment point already exists on the instrument, there is no need to drill additional holes in the instrument which would be inconvenient as well as decreasing the value of the instrument. Hinge pin 14 attaches flat support member 8 to the L bracket. Support member 8 is lying flat against the back of the instrument in this configuration. The compact nature of this design allows the user to play the instrument while the instrument stand 100 is in place on the instrument. Additionally, the flat support member 8 acts as a buffer between the belt buckle or shirt buttons of the player and the back of the instrument thereby reducing the possibility of scratching the back of the instrument 2. The L bracket 4 is made out of light weight material such as molded plastic or aluminum and the flat support member is made of light weight wood or aluminum so that the entire instrument stand 100 is light weight and does not adversely affect the person playing the instrument 2.

Figure 2:
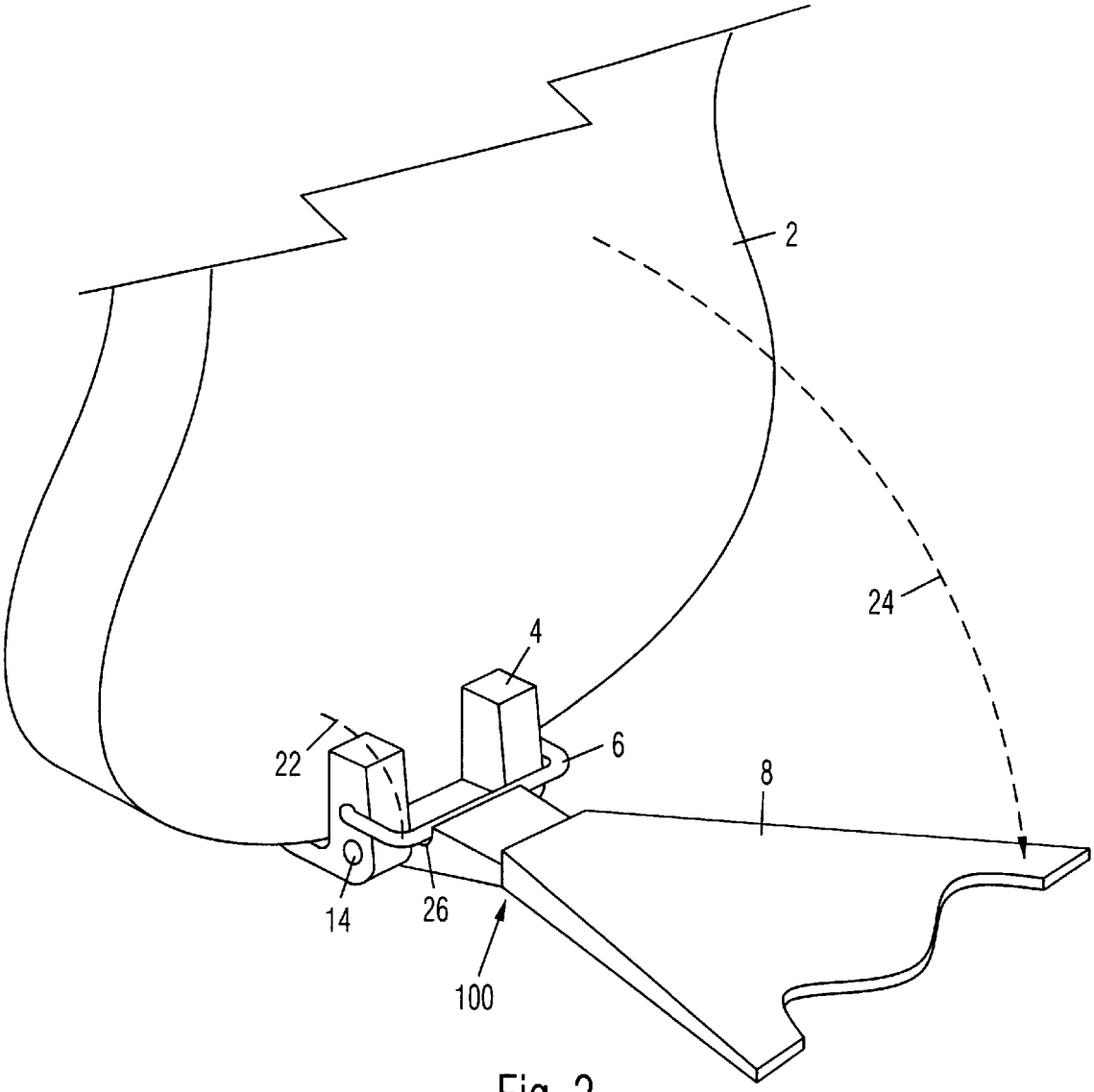
FIG. 2 is a perspective view of the stand of the present invention in its open position while mounted on a stringed instrument.
Figure 3:
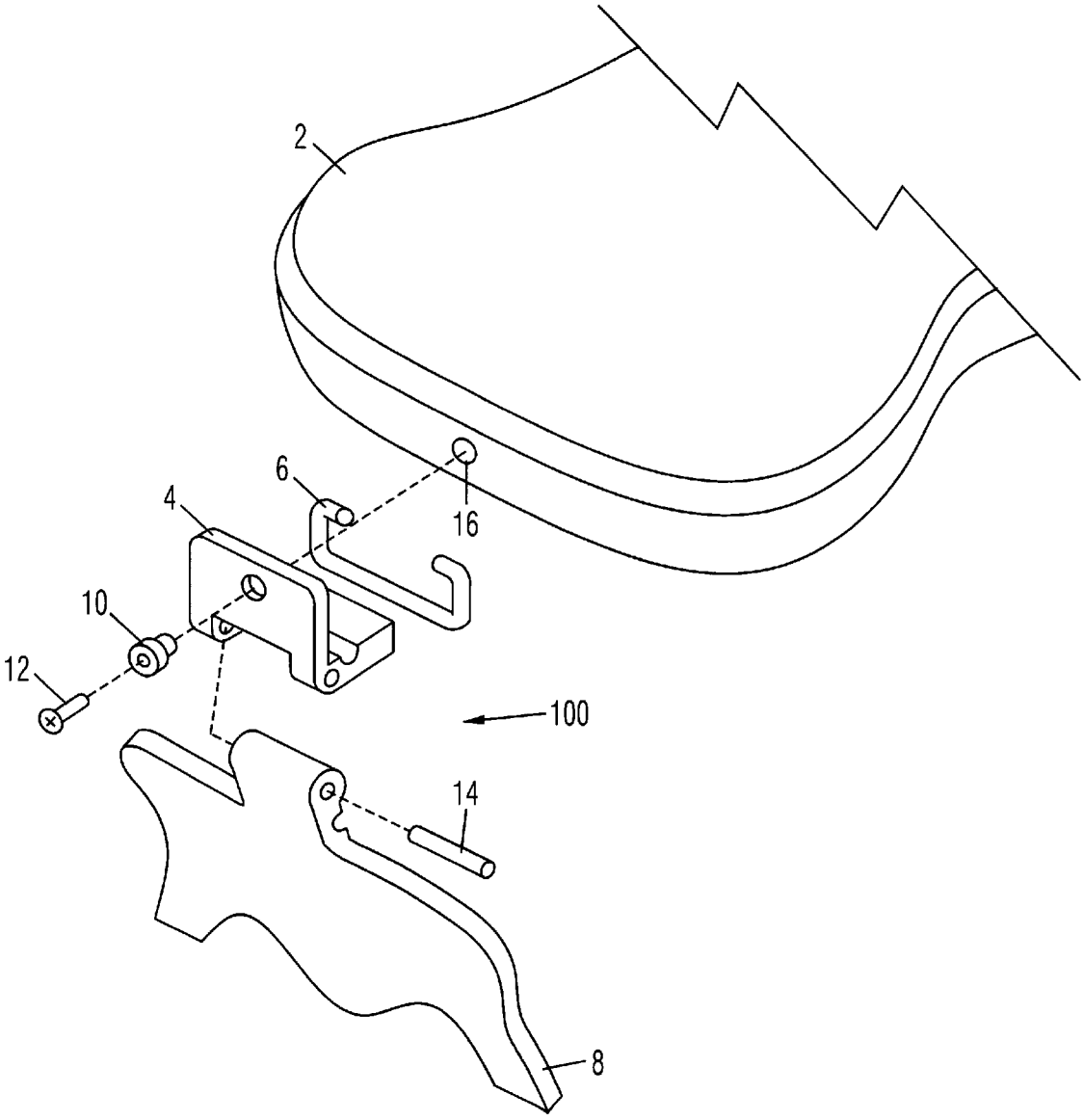
FIG. 3 is an exploded view of the stand of the present invention

FIG. 2 shows the present invention 100 in the use position as an instrument stand. Flat support member 8 has been folded down 24 and is held in place by metal clip 6 that is swung down 22 from its stored position. Retaining clip 6 is retained by detent 26 in support member 8 so that the instrument 2 is propped up at an ideal angle, about eighty degrees with respect to the floor, so that the instrument will not accidentally fall over. Hinge pin 14 holds flat support plate 8 to L bracket 4.

In the above described way, an instrument stand is provided that can be permanently attached to a stringed instrument at the point of the strap button. The configuration of the stand allows it to remain in place even when the instrument is being played or when it is placed in its case.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

We claim:

1. A stringed instrument stand, comprising:

an L shaped bracket having a centrally located clevis joint;

a hinged flat stand member; and a retaining clip;

said L shaped member being fixedly retained by a screw and strap button normally found at a base of stringed instruments;

said hinged flat stand member being held in place by a hinge pin and being retained in an open position by said retaining clip.

2. The stringed instrument stand as claimed in claim 1, wherein said flat stand member nests close to the back of said stringed instrument so that said instrument can be played while said instrument stand is affixed.

3. The stringed instrument stand as claimed in claim 1, wherein said instrument stand is made of rigid yet light weight materials.

4. The stringed instrument stand as claimed in claim 1, wherein said instrument stand is compact enough in its stored position that it can fit in a standard instrument case along with said instrument without being removed from said instrument.

* * * * *